US009092952B1

(12) United States Patent
Daniel

(10) Patent No.: US 9,092,952 B1
(45) Date of Patent: Jul. 28, 2015

(54) SYSTEM AND METHOD FOR NOTIFYING A USER OF AN OBJECT'S PRESENCE WITHIN A BOUNDARY

(71) Applicant: Isaac S. Daniel, Miramar, FL (US)

(72) Inventor: Isaac S. Daniel, Miramar, FL (US)

( * ) Notice: Subject to any disclaimer, the term of this patent is extended or adjusted under 35 U.S.C. 154(b) by 368 days.

(21) Appl. No.: 13/633,012

(22) Filed: Oct. 1, 2012

Related U.S. Application Data

(63) Continuation-in-part of application No. 12/833,664, filed on Jul. 9, 2010, now abandoned.

(60) Provisional application No. 61/255,201, filed on Oct. 27, 2009, provisional application No. 61/254,498, filed on Oct. 23, 2009.

(51) Int. Cl.
*G08B 17/00* (2006.01)
*G08B 1/00* (2006.01)

(52) U.S. Cl.
CPC ..... *G08B 1/00* (2013.01)

(58) Field of Classification Search
CPC ..... G07C 5/0008; G01S 15/04
USPC ..... 340/686.1, 539.1, 539.13, 539.23, 550, 340/551, 552, 568.6, 572.1; 473/569, 570
See application file for complete search history.

(56) References Cited

U.S. PATENT DOCUMENTS

2007/0299625 A1 12/2007 Englert et al.
2009/0029806 A1 1/2009 Hsu

*Primary Examiner* — Daryl Pope
(74) *Attorney, Agent, or Firm* — Carol N. Green Kaul

(57) ABSTRACT

A system that includes at least one processor, at least one 3D camera positioned on or near at least one boundary, at least one radio frequency identification tag reader positioned on or near the at least one boundary, at least one object having at least one radio frequency identification tag connected thereto, and computer executable instructions readable by the at least one processor and operative to use the at least one 3D camera to determine whether the at least one object is within at least one boundary, use the at least one radio frequency identification tag reader to determine whether the at least one radio frequency identification tag is within the at least one boundary, and notify at least one user when the at least one object encroaches the at least one boundary.

20 Claims, 14 Drawing Sheets

SYSTEM AND METHOD FOR NOTIFYING A USER OF AN OBJECT'S PRESENCE WITHIN A BOUNDARY

PRIORITY CLAIM

This patent application is a continuation-in-part patent application and claims priority to U.S. patent application Ser. No. 12/833,664, titled "System and Method for Notifying a User of an Object's Presence within a Boundary," filed on Jul. 9, 2010, by Isaac. S. Daniel, which claims priority to U.S. provisional patent application Ser. No. 61/255,201, titled "System and Method for Notifying a User of an Object's Presence within a Boundary," filed Oct. 27, 2009; and U.S. provisional patent application Ser. No. 61/254,498, titled "System and Method for Improving Object Detection," filed Oct. 23, 2009; all of which are hereby incorporated by reference as if fully stated herein.

FIELD

The present disclosure relates generally to electronic systems, and more particularly, to systems, apparatuses, methods, and various other disclosures for detecting objects on a playing field and notifying a user of such objects' presence on the playing field.

BACKGROUND

Some sports allow referees to make rulings during a game. In baseball, for example, an umpire is required to make a ruling as to whether a pitcher's pitch is a strike, or a ball. Referees and umpires in baseball also call whether players are out on base, or whether they are safe. Another example of a sport where a referee's judgment is critical to the outcome of a game is soccer, whereby the referee is required to call whether a goal has been scored or whether a player is off sides. Sports such as baseball and soccer, however, have not been able to capitalize on technological advancements in the electronics and communications field as the methods of making rulings on the field still rely heavily on a referee's sensory perception, such as sight and hearing.

Thus far, referees in sports still rely heavily on sensory perception when making rulings. More recently, referees have started to use replay technology to make rulings on the field, or to review rulings that have already been made. The use of replay technology, however, still relies on the referee's sensory perception, and is often inaccurate due to video angles that do not show the critical action. The use of replay technology is also cumbersome, since it requires some time for the referees to approach a viewing booth, watch the replay, and then convene to decide on the ruling, or whether the ruling on the field will stand as called.

Therefore, current methods and systems used for making rulings on sports field have thus far proven to be unreliable and inefficient.

SUMMARY

The systems, methods, and apparatuses described herein result from the realization that rulings on the field can be made in an efficient and reliable manner, by providing a system, method, and/or apparatus which can detect an object in a given boundary, such as a baseball in a strike zone, or a ball in a goal. Such a system may comprise of at least one sensor, a processor, and computer executable instructions readable by the processor and operative to determine whether an object is within a given boundary. Furthermore, the computer executable instructions readable are operative to project a visual representation of the boundary and the object on a on-field user's headwear display device.

DETAILED DESCRIPTION OF PREFERRED EMBODIMENTS

System Level Overview

Figure 1A:
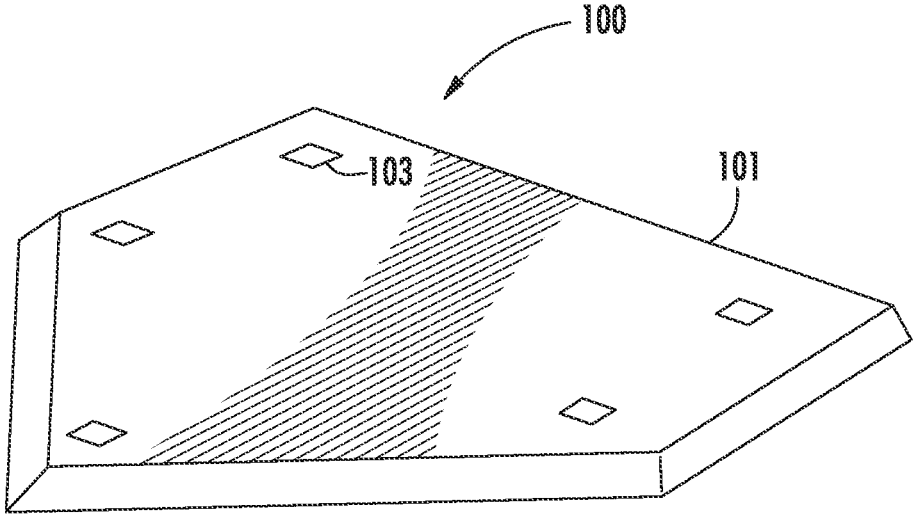
FIG. 1A shows an apparatus in accordance with one embodiment.

The following discussion describes in detail an embodiment of the subject apparatuses, methods, and systems (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1A through 7 illustrate the systems, apparatuses, and methods of the present disclosure.

Figure 1B:
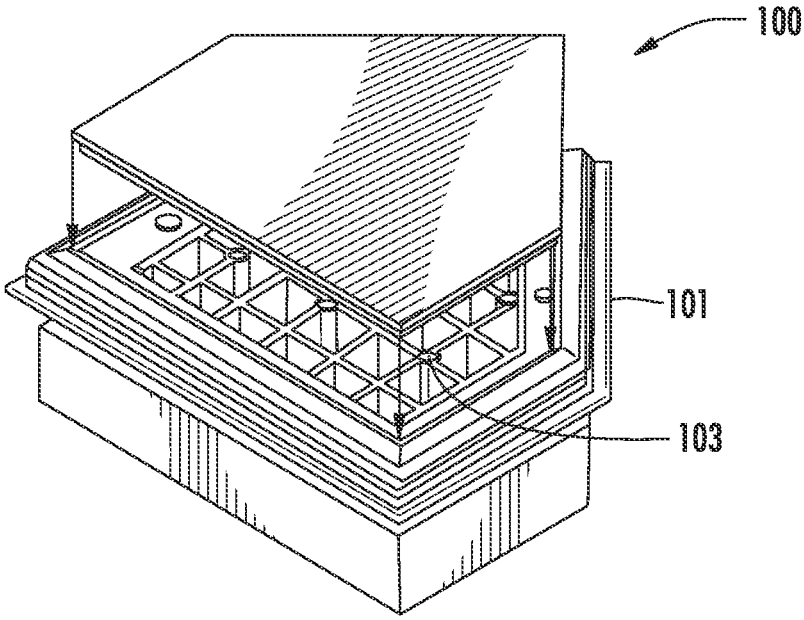
FIG. 1B shows an exploded view of an apparatus in accordance with another embodiment.

FIGS. 1A and 1B show apparatus 100, in accordance with one embodiment. In one embodiment, apparatus 100 comprises a plate 101, and at least one sensor 103 connected to plate 100. In some embodiments sensor 103 may be positioned near the surface of plate 101, as shown in FIG. 1A. In other embodiments, sensor 103 may be positioned below the surface of plate 101, as shown in FIG. 1B.

In one embodiment, plate 101 may be a baseball plate. In another embodiment, plate 101 may be a home plate. It is to be understood that plate 101 may be any kind of plate, including but not limited to, a baseball plate, a home plate, and a generic plate.

In one embodiment, sensor 103 may be a range finder sensor. In some embodiments, the range finder sensor may be any kind of range finder sensor, including, but not limited to, an ultrasonic range finder sensor, an infrared range finder sensor, a laser range finder sensor, a photo range finder sensor, or any other type of range finder sensor. In another embodiment, sensor 103 may be a radio frequency identification (RFID) sensor. In yet another embodiment, sensor 103 may include a receiver and/or transmitter of a short range wireless protocol, such as, but not limited to, WiHLoN™, Zigbee, Blue Tooth, 802.11 series, or any other short range wireless protocol.

Figure 4:
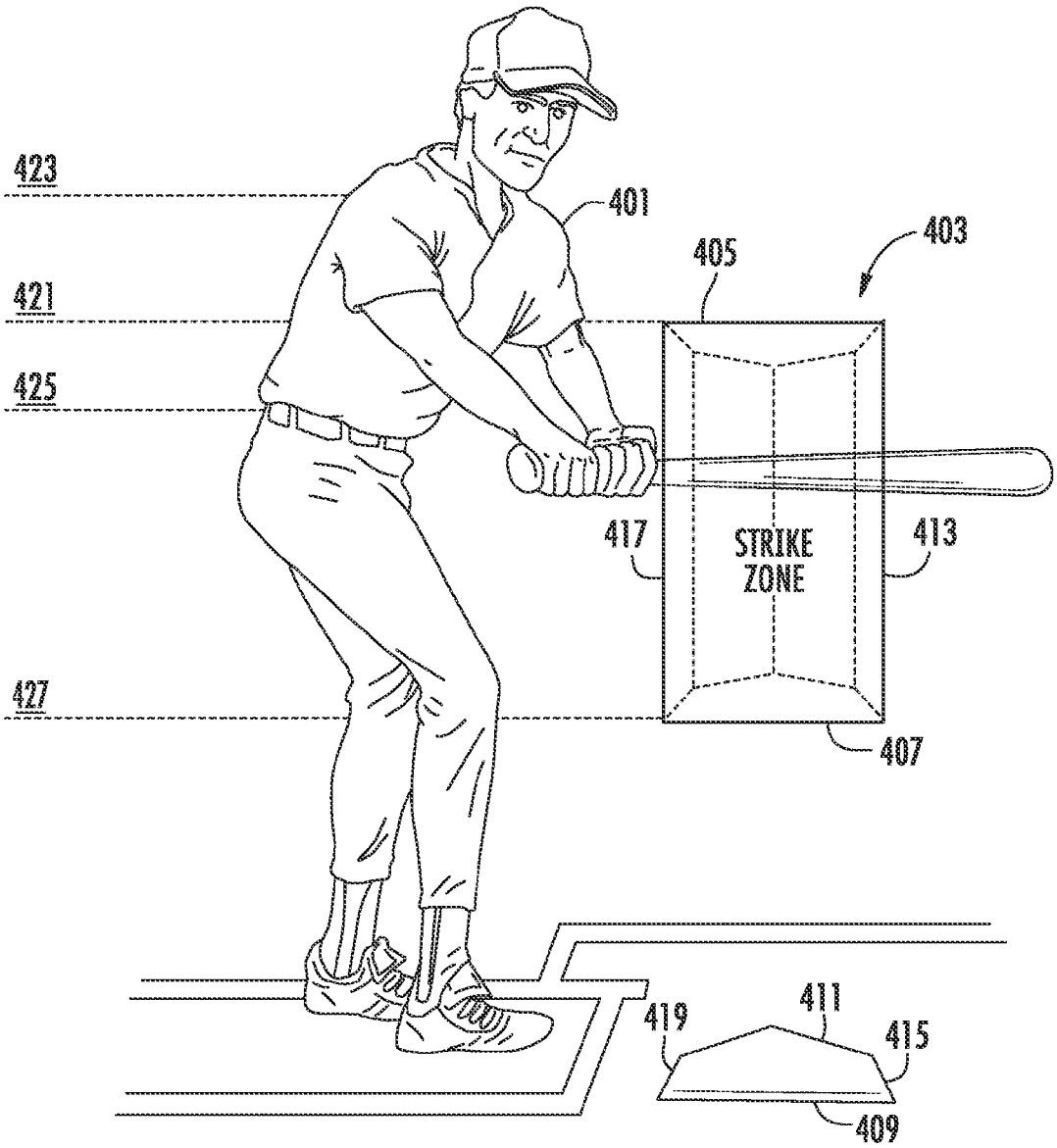
FIG. 4 shows a baseball player and a strike zone in accordance with various embodiments.

Any of the aforementioned embodiments of sensor 103 may detect an object, such as a ball, in a given boundary. In some embodiments, sensor 103 detects a player in certain boundary, such as an in bounds area, or over or on a base. In other embodiments, sensor 103 may detect an object, such as a puck, ball or a bat, in a given boundary, such as a strike zone (as shown in FIG. 4) or a goal.

In some embodiments, sensor 103 may measure the distance between the object it is detecting and the sensor itself. In yet other embodiments, a plurality of sensors may measure the distance between the object they are detecting and the respective sensor. In one embodiment, a processor (not shown) may calculate the position of the object based on the various measurements taken by the sensors, and in further embodiments, the processor, based on these calculations can determine whether the object is within a given boundary, such as a strike zone (as shown in FIG. 4). Such a processor may perform calculations based on, but not limited to, triangulation or quadrangilation, such as those used in global positioning systems, wireless positioning systems, local positioning systems, indoor positioning systems, and the like.

In further embodiments, the determination of the processor may be displayed on a screen. In yet further embodiments, the position of the object may displayed on the screen. In some embodiments, that screen may be located on an article of user hardware, such as those described below. In other embodiments, the determination that an object is present in a given boundary may activate an alarm, such as a vibrating alarm, to notify a person, such as a referee, that an object is within a given boundary. In some embodiments, when the processor determines that an object, such as a baseball, is within a given boundary, such as a strike zone (as shown in FIG. 4), the processor may send a signal to an alarm, thereby notifying a user that an object is in a given boundary, such as a baseball being in a strike zone (as shown in FIG. 4). In other embodiments, the processor may send a signal to at least one camera (as discussed below). In further embodiments, the processor may signal a camera to record the position of the object (also discussed below).

In yet another embodiment, sensor 103 may include a pressure sensor. In some embodiments, when sensor 103 senses pressure, an alarm may be activated, thereby notifying a user. In one embodiment, such an alarm may notify a user, such as a referee, that an object, such as a player is standing over or on a given boundary, such as a baseball plate.

In some embodiments, sensor 103 may detect a tag (not shown) in a given boundary, such as an RFID active or passive tag, or a short range wireless protocol receiver or transmitter. In some embodiments, a processor can disregard the sensor's measurement with regards to a foreign object bearing such a tag, where the presence of the foreign object may otherwise interfere with determining whether an object is in a given boundary or not.

Figure 2:
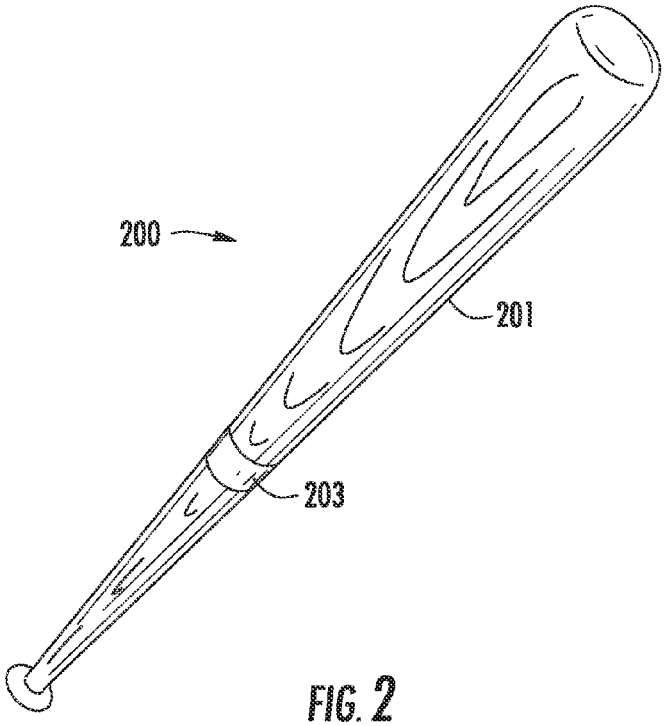
FIG. 2 shows an apparatus in accordance with another embodiment.

FIG. 2 shows an apparatus 200 in accordance with one embodiment. Apparatus 200 comprises an article of sports equipment 201, and at least one tag 203 connected to said article. In one embodiment, article 201 may be a bat, such as a baseball bat, as shown in FIG. 2. In another embodiment, article 201 may be an article of clothing, or head wear. In one embodiment, tag 203 may be embedded in article 201. In other embodiments, tag 203 may be positioned on the surface of article 201. In yet further embodiments, article 200 may include a battery (not shown), which may power tag 203.

In some embodiments, tag 203 may be an active tag, such as an active RFID tag, infrared tag, or the like. In other embodiments, tag 203 may be a passive tag, such as a passive RFID tag, or the like. In yet other embodiments, tag 203 may include a transmitter or receiver of a short range wireless protocol, such as, but not limited, to WiHLoN™, Zigbee, Blue Tooth, 802.11 series, or any other short range wireless protocol. In other embodiments, tag 203 may be detachably connected to article 201.

In some embodiments, tag 203 may be used by a camera, sensor, and/or processor, such as those described with reference to FIGS. 1A and 1B, to distinguish between an object whose presence is desired for calculation purposes, and a foreign object, whose presence may otherwise interfere with calculations. In one embodiment, determining whether an object, such as a baseball or a puck, is present in a given boundary, such as a strike zone (as shown in FIG. 4) or a goal, may be desirable. In such an embodiment, the presence of a foreign object, such as a bat or a hockey stick, may interfere with determining whether the principal object is in the given boundary. More specifically, in some embodiments, without tag 203, the camera, sensor, and/or processor, performing the calculations and determinations would not be able to distinguish the presence of a foreign object in a given boundary.

Figure 3:
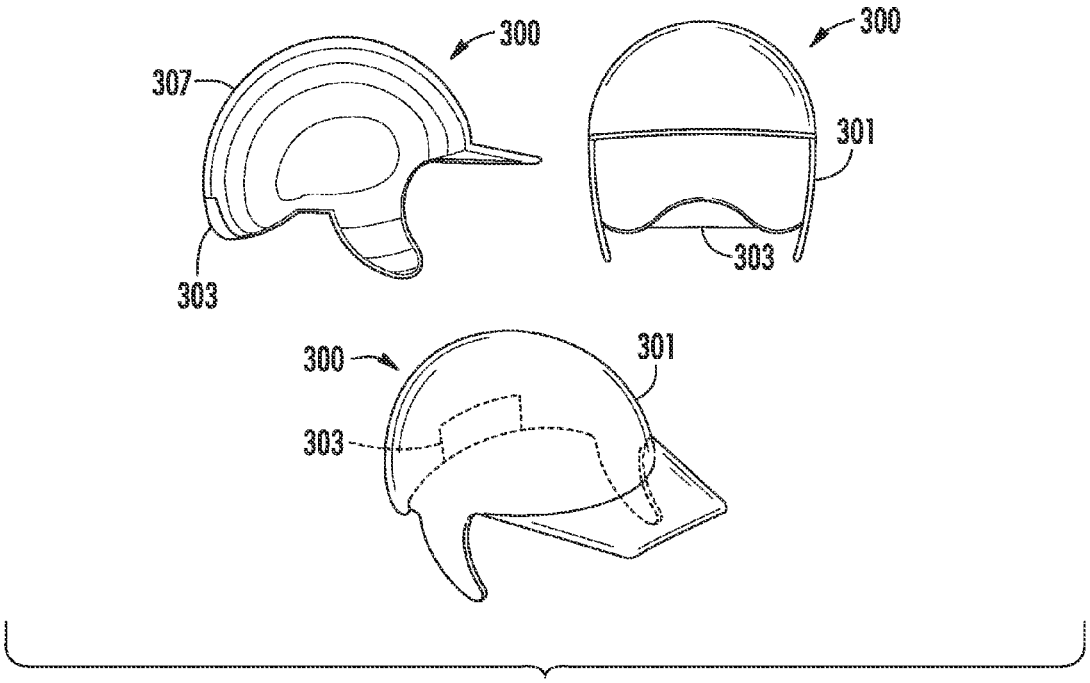
FIG. 3 shows an apparatus in accordance with yet another embodiment.

FIG. 3 shows an apparatus 300 in accordance with one embodiment. Apparatus 300 comprises an article of sports equipment 301, and at least one tag 303 connected to said article. In some embodiments, article 301 may be an article of clothing, or head wear. In another embodiment, article 301 may be a helmet, as shown in FIG. 3. In yet other embodiments, article 301 may be an article of sports equipment, such as a ball, including but not limited to, a baseball. In yet another embodiment, tag 303 may be embedded in article 301. In other embodiments, tag 303 may be positioned on the surface of article 301. In yet further embodiments, article 300 may include a battery (not shown), which may power tag 303.

In some embodiments, tag 303 may be an active tag, such as an active RFID tag, infrared tag, or the like. In other embodiments, tag 303 may be a passive tag, such as a passive RFID tag, or the like. In yet other embodiments, tag 303 may include a transmitter or receiver of a short range wireless protocol, such as, but not limited, to WiHLoN™, Zigbee, Blue Tooth, 802.11 series, or any other short range wireless protocol. In other embodiments, tag 303 may be detachably connected to article 301.

In some embodiments, tag 303 may be used by a camera, sensor, and/or processor, such as those described with reference to FIGS. 1A and 1B, to distinguish between an object whose presence is desired for calculation purposes, and a foreign object, whose presence may otherwise interfere with calculations. In one embodiment, determining whether an object, such as a baseball or a puck, is present in a given boundary, such as a strike zone (as shown in FIG. 4) or a goal, may be desirable. In such an embodiment, the presence of a foreign object, such as a user, may interfere with determining whether the principal object is in the given boundary. More specifically, in some embodiments, without tag 303, the camera, sensor, and/or processor performing the calculations and determinations would not be able to distinguish the presence of a foreign object in a given boundary.

In other embodiments, tag 303 may be used by a, camera, sensor, and/or processor, to determine the physical dimensions of a given boundary. In one embodiment, a plurality of cameras, sensors, and/or processors may be used to determine whether a baseball is in a strike zone (as shown in FIG. 4). In such an embodiment, the height of the strike zone (as shown in FIG. 4) may vary from batter to batter, and tag 303 may be used to calculate the height and position of the strike zone. In some embodiments, players who are shorter may have a shorter and/or lower strike zone, while players who are taller may have a taller and/or higher strike zone. In such an embodiment, tag 303 may positioned on or near the player, or on a player's article of clothing or sports equipment so that a sensor and/or camera may detect tag 303 and measure the distance between tag 303 and the sensor. A processor (not shown) may then use this measurement to calculate and determine the height and position of a strike zone (as described in detail below). In other embodiments, a processor, using image recognition software, may be able to use a camera to determine the height of a player, and thus, the height and position of the strike zone. While some of the embodiments may refer to the sport of baseball, it is to be understood that the various methods, apparatuses, and systems described herein may apply to other forms of sports and activities.

FIG. 4 shows a diagram of a baseball player 401 and a strike zone 403, in accordance with some of the embodiments previously described. In some embodiments, strike zone 403 may be a boundary represented by a first surface 405, set at the midpoint 421 between the top of the player's shoulders 423 and the player's waist and/or top of pants 425, first surface 405 being oriented substantially horizontal, a second surface 407 set at the player's hollow beneath the kneecap 427, second surface 407 being oriented substantially horizontal, a third surface (not indicated), set along a front edge of a plate 409, the third surface being oriented substantially vertical, a fourth surface (not indicated) set along a rear edge of the plate 411, the fourth surface being oriented substantially vertical, a fifth surface 413 set along a first side edge of the plate 415, fifth surface 413 being oriented substantially vertical, and a sixth surface 417 set along a second side edge of the plate 419, sixth surface 417 being oriented substantially vertical. Such a strike zone would be encompassed by the common space enclosed by all of the aforementioned surfaces.

Figure 5A:
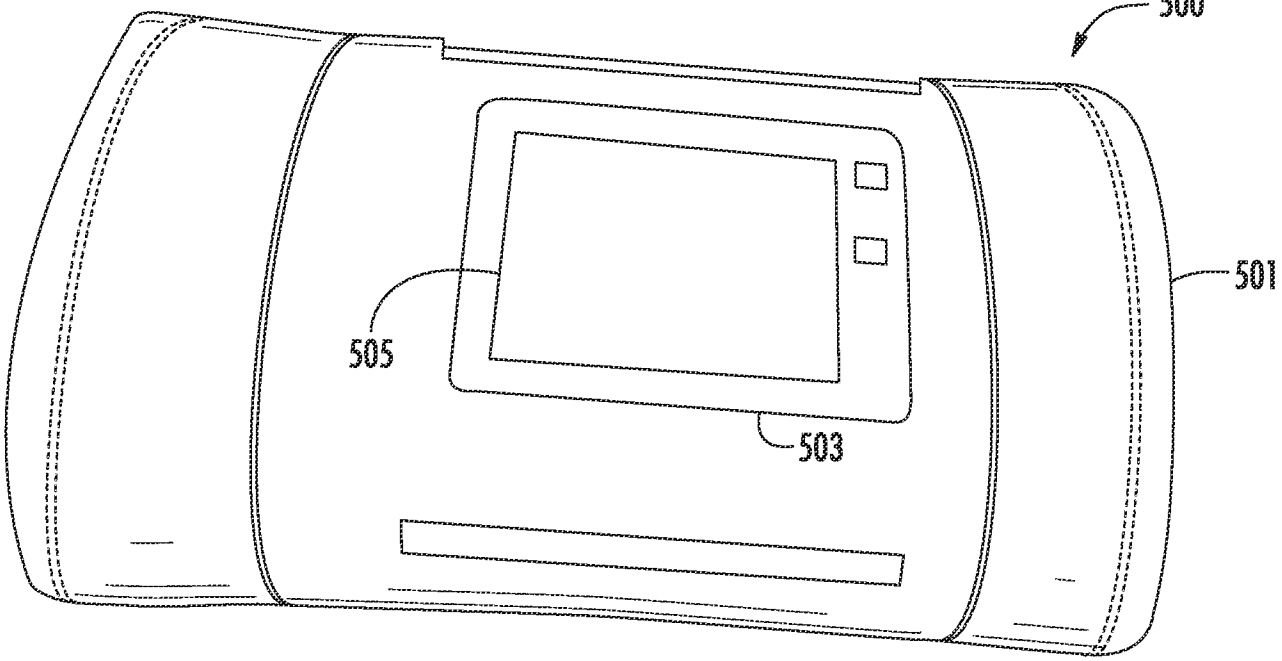
FIG. 5A shows an apparatus in accordance with one embodiment.
Figure 5B:
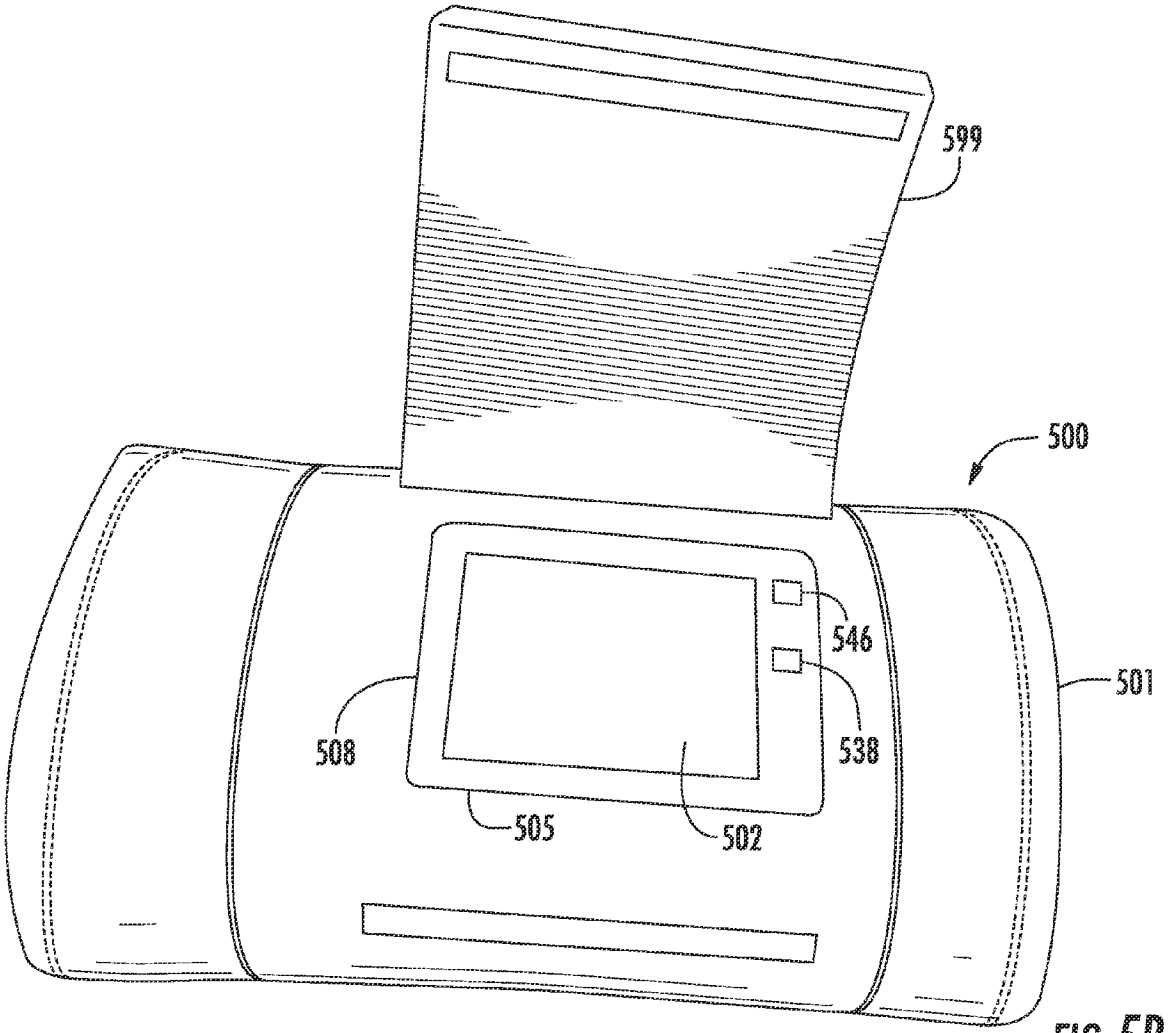
FIG. 5B shows an apparatus in accordance with another embodiment.

FIGS. 5A and 5B show an apparatus 500, in accordance with one embodiment. In some embodiments, apparatus 500 comprises at least one article of wear 501, and at least one processing unit 503 connected to the article of wear, processing unit 503 operative to process information from at least one sensor and/or camera located on a playing field. In some embodiments, that sensor may be any of those described throughout this disclosure.

In one embodiment, article of wear 501 may be a wristband. In other embodiments, article of wear 501 may be any other article of wear, such as, but not limited to, an arm band, a hat, a knee band, a belt, detachable article, and the like.

In a further embodiment, the at least one sensor and/or camera from which processing unit 503 is operative to process information is located on a baseball field. In another embodiment, the sensor is connected to a baseball plate. In yet another embodiment, the sensor may be located on a person's body, such as a player.

In some embodiments, apparatus 500 further comprises an alarm means. Such alarm means may include, but is not limited to, a vibrating alarm, a sounding or audible alarm, or a visual alarm. In other embodiments, the alarm means may be included and/or incorporated in processing unit 503.

In some embodiments, apparatus 500 further comprises a display means 505. Display means 505 may include a screen, such as a liquid crystal display (LCD) screen, a light emitting diode screen (LED), or the like. In one embodiment, display means 505 may display information to a user. Such information may include whether or not an object is within a given boundary. In further embodiments, display means 505 may serve as the aforementioned alarm means, by displaying a certain image, such as the word "strike," "ball," "out," and/or "goal." In another embodiment, display means 505 may display a virtual image of the object's position within the boundary. In yet another embodiment, display means 505 may display an actual image of the object's position within the boundary. In other embodiments, display means 505 may be included and/or incorporated in processing unit 503.

In a further embodiment, processing unit 503 may include a transmitting means or receiving means for transmitting and/or receiving signals from the at least one sensor and/or camera.

Figure 5C:
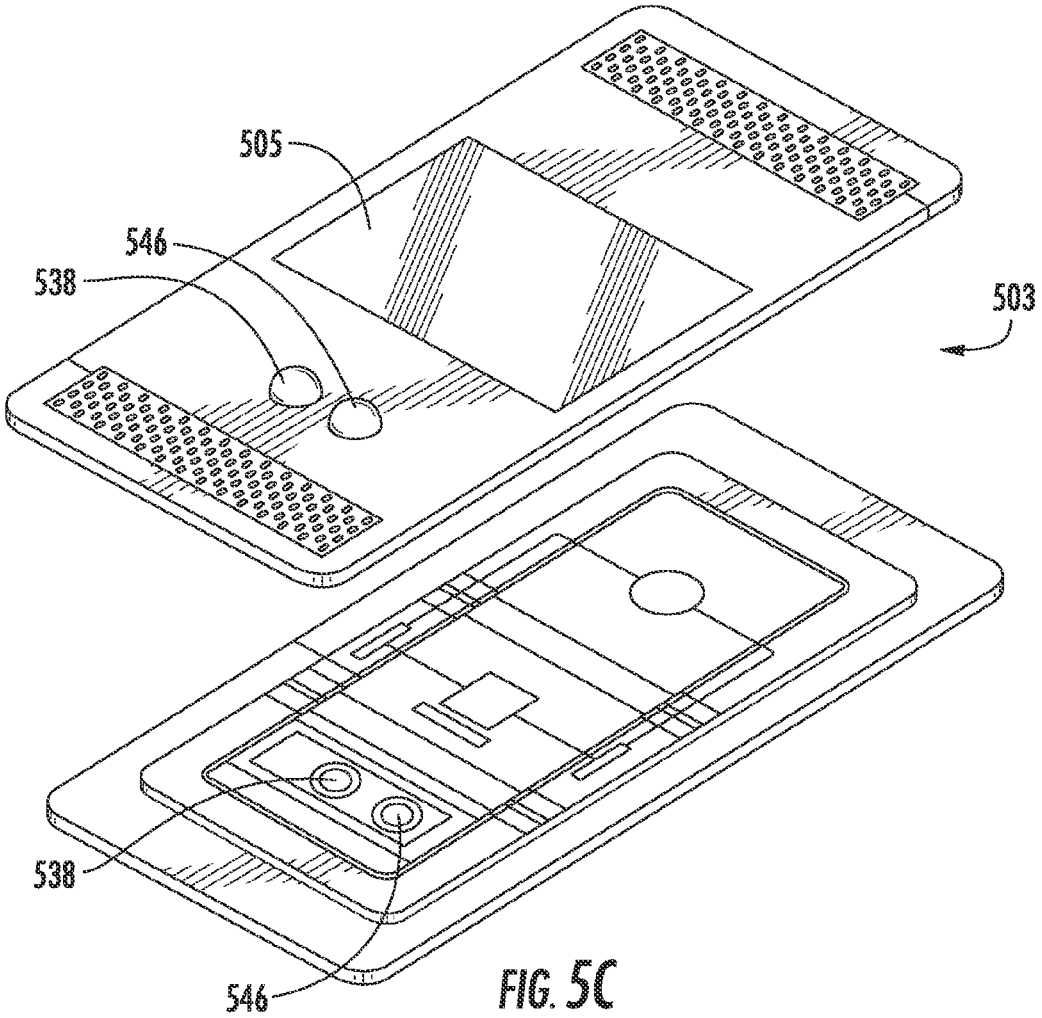
FIG. 5C shows a processing unit in accordance with one embodiment.

Referring now to FIGS. 5B and 5C, which shows one embodiment of apparatus 500, wherein apparatus 500 further includes a cover 599. In one embodiment, cover 599 serves to protect processing unit 503 from impact.

In some embodiments, apparatus 500 may be worn by a user, such as a referee, to be used in conjunction with the various apparatuses described throughout this disclosure.

In some embodiment, processing unit 503 comprises of a transparent protective cover 502 having a smooth contour with no sharp edges that is the same contour and shape as a middle portion which is provided with a display means 505, which are enclosed by a rear cover (not shown) forming a housing 508 for a receiving means (not shown) of apparatus 500, all positioned on the upper portion of an elasticized band.

In some embodiments, the elasticized band of the apparatus has an aperture for receiving the player's body parts, e.g. wrists, therein and is sized to fit the player's body parts or a belt. The elasticized band may also include an extended flap, which is provided with a closing means (not shown) on an underside of the extended flap, used to secure the apparatus 500 to a selected portion of a user's body, e.g. the wrist, upper arms, or knees, or to a belt. Said closing means (not shown) may include cooperating closing elements including a plurality of miniature monofilament hook elements cooperating with a plurality of miniature monofilament loop elements, or any other closing means (not shown) suitable for detachably securing and unsecuring fabrics or materials. The monofilament hook elements are affixed to an upper surface of the underside of the extended flap, while the monofilament loop elements are affixed to the upper portion of the elasticized band, or vice versa, to detachably secure apparatus 500 to the player's body parts or a belt.

In some embodiments, article 501 may be seamingly connected by stitches, glue, or detachably secured with closing means (not shown), e.g. hooks and loops connectors, commonly referred to as Velcro®, to apparatus 500, or article 501 may be in combination with apparatus 500 forming a single, non-detachable unit. However, article 501 may include a belt or any other style glove suitable for the sport, e.g. baseball, golf. It is understood that if article 501 is a belt, the belt may not be seamingly connected to the apparatus 500 but may be secured via the closing means (not shown) of the apparatus 500. In further embodiments, apparatus 500 may be worn as an armband, a wristband, a thigh band or with a detachable personal article, e.g. a belt.

In yet other embodiments, positioned on the exterior surface of processing unit 503 is activation switch 538, which may be used to at least one of, activate and/or reactivate display means 505 to display an image on the display means 505. Processing unit 503 (not shown) may include a microprocessor (not shown) electrically connected to display means 505 programmed to perform any one of the following: flash a light on the display means 505 or display text and/or visual format of the intended image. Also positioned on an exterior surface of processing unit 503 is the send button 546 which may be used to transmit a signal to a secondary receiver (not shown).

It is understood that all players or referees on or off the field and/or court may wear apparatus 500.

In some embodiments, a transmitting means (not shown) and the receiving means (not shown) include a combined wireless transceiver, e.g. a Zigbee transceiver with integrated radio and shared antennae. However, other wireless transceivers that are well known and used in the arts may be used to practice the apparatus. In other embodiments, activation switch 538 and the send button 546 are positioned on the upper exterior surface of processing unit 503. However, it is understood that they both could easily have been on the side or any other location on the exterior surface of processing unit 503.

In yet other embodiments, the middle portion and the protective cover 599 of the apparatus may have any one of the following shapes: circular, oblong, or rectangular. Said protective cover 599 protects the middle portion, the display means 505 and circuits positioned therein. As such, the protective cover 599 may be formed from a semi-rigid material to prevent breakage, damage and injury to the player and in certain embodiments of the invention treated to have a magnifying effect. In alternate embodiments of the apparatus, the display means 505 is provided with lighting or backlighting such that it can be used at night without compromising the visibility of the display.

In some embodiments, upon receipt of a signal, the microprocessor of processing unit 503, sends an alarm signal to the alarm means (not shown), thereby alerting the user of the receipt of a transmission of a signal, such as that of an intended ruling, such as "strike" or "out", all executed within a matter of seconds. The alarm means (not shown) may comprise of a vibration motor (not shown) electrically connected to the circuit board capable of causing a vibration of apparatus 500, or may include dual-tone multi-frequency ("DTMF") decoders (not shown) also electrically connected to the circuit board and speaker (not shown) capable of sounding an audio alarm; a single tone alert system (not shown) sounding an alarm like a Sonalert; or the microprocessor electrically connected to the display means 505 programmed to flash a light thereon on receipt of the encrypted signal of the intended message. In this manner, the alarm means may cause for example a vibration of the apparatus, sound an audio alarm or flash a light, thereby alerting the user of the receive signal.

In some embodiments, if the extended flap is in the closed position a player may undo the closing means (not shown) of the extended flap and activate the display means 505 by using the activation switch 538 to display the message on the display means 505, which may display either a text message and/or a visual display. However, in alternate embodiments of the apparatus, the apparatus 500 may not include an extended flap or a user may choose to keep it in an open position. In either event, the apparatus 500 may automatically display the intended message without being activated by the activation switch 538.

In some embodiments, the processing unit 503 may be programmed to activate the display means 505 to display the intended message for a predetermined period, e.g. 10-20 seconds and will continue to verify if the display time has expired. Once the display time has expired, the microprocessor will deactivate the display means 505 and cease the display. However, the display means 505 may be reactivated to re-display the intended message, by depressing the activation switch 538. In this manner if a user forgets the intended message he has an opportunity to review the intended message after the display has ceased.

In some embodiments, processing unit 503 includes a circuit (not shown). The circuit is comprised of a circuit board, having a power source and microprocessor positioned thereon. Conventional wires connect the circuit board with the activation switch and the send button. Preferably, the circuit board is formed from a polyimide film which is flexible yet can remain stable in a wide range of extreme temperatures, e.g. Kapton®. However, the circuit board may be formed from silicon, fiberglass, Mylar, or other suitable materials that are well known and used in the arts. The circuit board is small enough to be contained within the housing 508 of the middle portion of the processing unit 503. In some embodiments, an antenna may be electrically connected to the microprocessor on the circuit board or alternatively imbedded within the microprocessor. Alternatively, the antenna may be incorporated within a wiring harness (not shown) or sewn into the fabric of the elasticized band.

In some embodiments, apparatus 500 includes communication means (not shown) for the receipt and transmissions of wireless communications through a wireless communications medium (not shown). Said communication means (not shown) may include but is not limited to Blue Tooth, Zigbee, 802.11 series, or any other short range wireless protocol that is well known and used in the arts and other future short range wireless protocol suitable for transmitting and receiving data over a short distance. Upon receipt of a signal, the microprocessor of the processing unit 503, sends an alarm signal to the alarm means (not shown) of the receipt of the incoming transmission, causing for example a vibration of the apparatus 500, thereby alerting the player of the received intended transmission. The player may activate the display means 505 by using the activation switch 538 to view the intended transmission on the display means 505 which displays either a text message and/or a visual display for a predetermined period of time, such as, for example, ten seconds.

Figure 6:
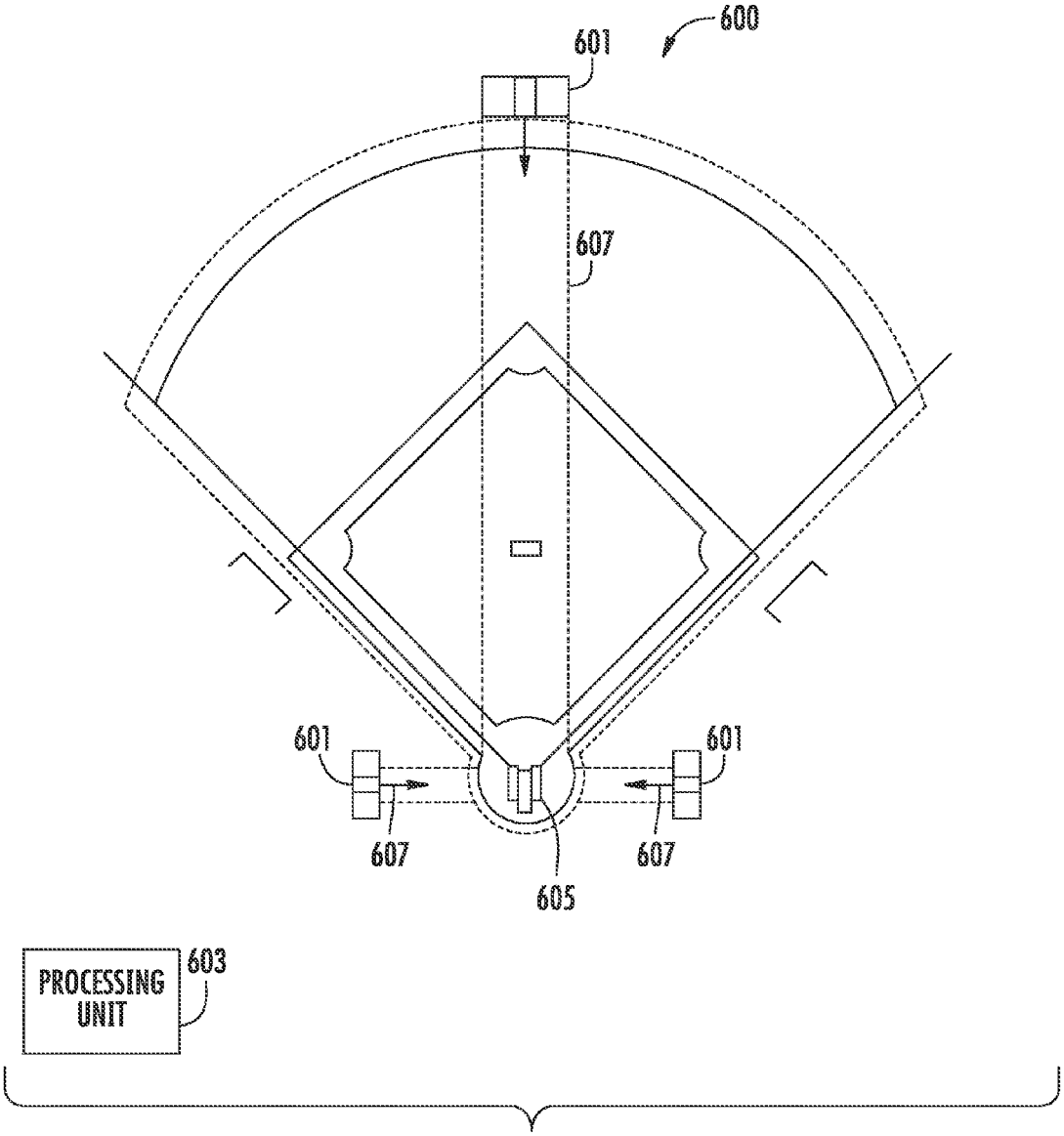
FIG. 6 shows a system in accordance with one embodiment.

FIG. 6 shows a system 600 in accordance with one embodiment. System 600 comprises at least one camera 601 having a field of view 607, at least one processing unit 603 connected to camera 601, and computer executable instruction (not shown) readable by the processor and operative to determine whether an object in the at least one camera's field of view is within a given boundary 605.

In one embodiment, camera 601 is a motion picture camera. In another embodiment, camera 601 is a still image camera. In yet another embodiment, camera 601 is capable of tracking the object. Camera 601 may be, but is not limited to, an analog camera, a digital camera, a high definition digital camera, and/or and ultra high definition digital camera. In some embodiments, camera 601 may include a powerful lens. In some embodiments, camera 601 is capable of capturing objects that are travelling at high speeds, such as speeds in excess of 100 mph, and that are travelling at a great distance, such as greater than 100 yards. In further embodiments, there may be a plurality of cameras 601, wherein each camera 601 may have a different perspective of the same boundary 605 (as shown in FIG. 6). In one embodiment boundary 605 may be a baseball strike zone (as described above with reference to FIG. 4).

In one embodiment, system 600 further comprises an apparatus (not shown) in communication with processing unit 603, and capable of receiving a signal from processing unit 603. In some embodiments, the apparatus may be an apparatus such as those described herein with reference to FIGS. 5A and 5B. In other embodiments, processing unit 603 may be incorporated into the apparatus. In yet another embodiment, the apparatus comprises a display means (not shown), such as those described herein with reference to FIGS. 5A and 5B. In some embodiments, the apparatus may be wirelessly connected to processing unit 603. In various embodiments, the apparatus and/or processing unit 604 may include a transmitter or receiver of a short range wireless protocol, such as, but not limited, to WiHLoN™, Zigbee, Blue Tooth, 802.11 series, or any other short range wireless protocol.

In various embodiments, processing unit 603 maybe wirelessly connected to camera 601. Accordingly, camera 601 may include a transmitter or receiver of a short range wireless protocol, such as, but not limited, to WiHLoN™, Zigbee, Blue Tooth, 802.11 series, or any other short range wireless protocol.

Figure 7:
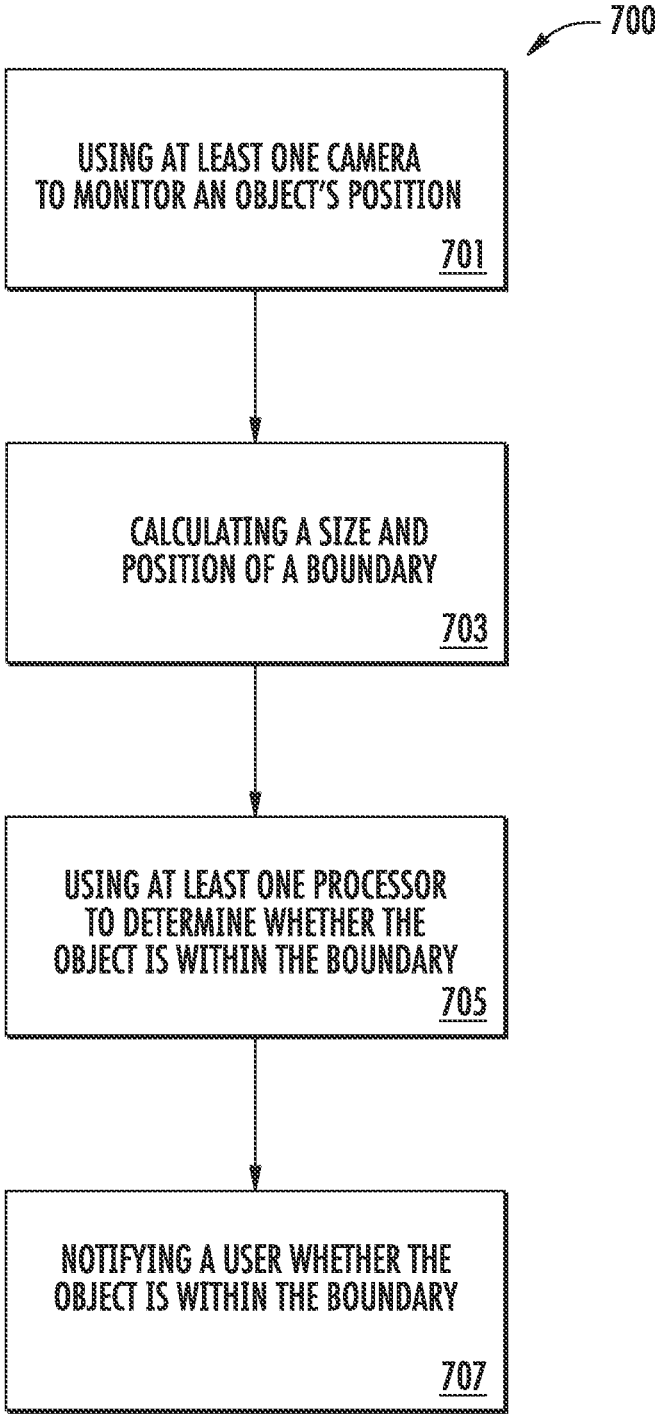
FIG. 7 shows a method for notifying a user of an object's presence within a boundary.

FIG. 7 shows a flow chart illustrating a method for notifying a user of an object's presence within a boundary 700, in accordance with one embodiment. Method 700 comprises using at least one camera to monitor an object's position (block 701), calculating a size and position of a boundary (block 703), using at least one processor to determine whether the object is within the boundary (block 705), and notifying a user whether the object is within the boundary (block 707).

In one embodiment, using at least one processor to determine whether the object is within the boundary (705) includes using computer executable instructions to determine whether the object is within the boundary.

In further embodiments, calculating a size and position of a boundary (703) comprises calculating a midpoint between a top of a person's shoulders and a person's waist, setting a first surface of the boundary at the midpoint, such that the first surface is horizontal, setting a second surface of the boundary at the person's hollow beneath the kneecap, such that the second surface is horizontal, setting a third surface of the boundary along a front edge of a plate, such that the third surface is vertical, setting a fourth surface of the boundary along a rear edge of the plate, such that the fourth surface is vertical, setting a fifth surface of the boundary along a first side edge of the plate, such that the fifth surface is vertical, and setting a sixth surface of the boundary along a second side edge of the plate, such that the sixth surface is vertical. In some embodiments, the boundary may be a baseball strike zone, as described with reference to FIG. 4. Such a strike zone would be encompassed by the common space enclosed by all of the aforementioned surfaces.

In some embodiments of method 700, calculating a size and position of a boundary 703 comprises using a camera to calculate a size and position of a boundary. In yet other embodiments, calculating a size and position of boundary 703 further includes using a camera in conjunction with image recognition software, or 3D depth sensing and/or gesture control software, to calculate a size and position of a boundary, such as a strike zone. The 3D image analysis software may be similar to those developed by Softkinetic S.A., 24 Avenue L. Mommaerts, Brussels, B-1140, Belgium, Microsoft Corp., and Omek Interactive, 2 Hahar Street, Industrial Zone Hare Tuv A, Ganir Center, Beith Shemesh 99067, Israel. In such embodiments, calculating a size and position of a boundary includes analyzing a captured image using image recognition software to determine a boundary. In some embodiments, such analysis may include any of the steps carried out to determine the dimensions of a strike zone, as described in the immediately preceding paragraph and/or elsewhere throughout the present disclosure.

In other embodiments, calculating a size and position of a boundary 703 may include using at least one sensor to calculate a size and position of a boundary. Such sensor and methods of calculating the boundary may include any of those embodiments described throughout the present disclosure. In some embodiments, using at least one sensor to measure calculate a size and position of a boundary may include using a sensor to measure a height of a player, and calculating a height of a strike zone based on the measured height of the player. In further embodiments, using at least one sensor to measure a height of a player comprises using at least one sensor to measure a distance between the sensor and a tag connected to the player. In some embodiments, measuring the distance between the sensor and a tag includes using a processor to calculate the position of the tag by using biangulation, triangulation, or quadrangilation.

In some embodiments, notifying a user 707 comprises notifying a user via wireless communication. In yet other embodiments, notifying a user 707 further comprises using a wireless device to notify a user. In some embodiments, the wireless device may include the apparatus described with reference to FIGS. 5A and 5B. Accordingly, where wireless communications are concerned, any of the wireless apparatuses, methods, systems, and other embodiments described herein may be applied where appropriate.

Figure 8:
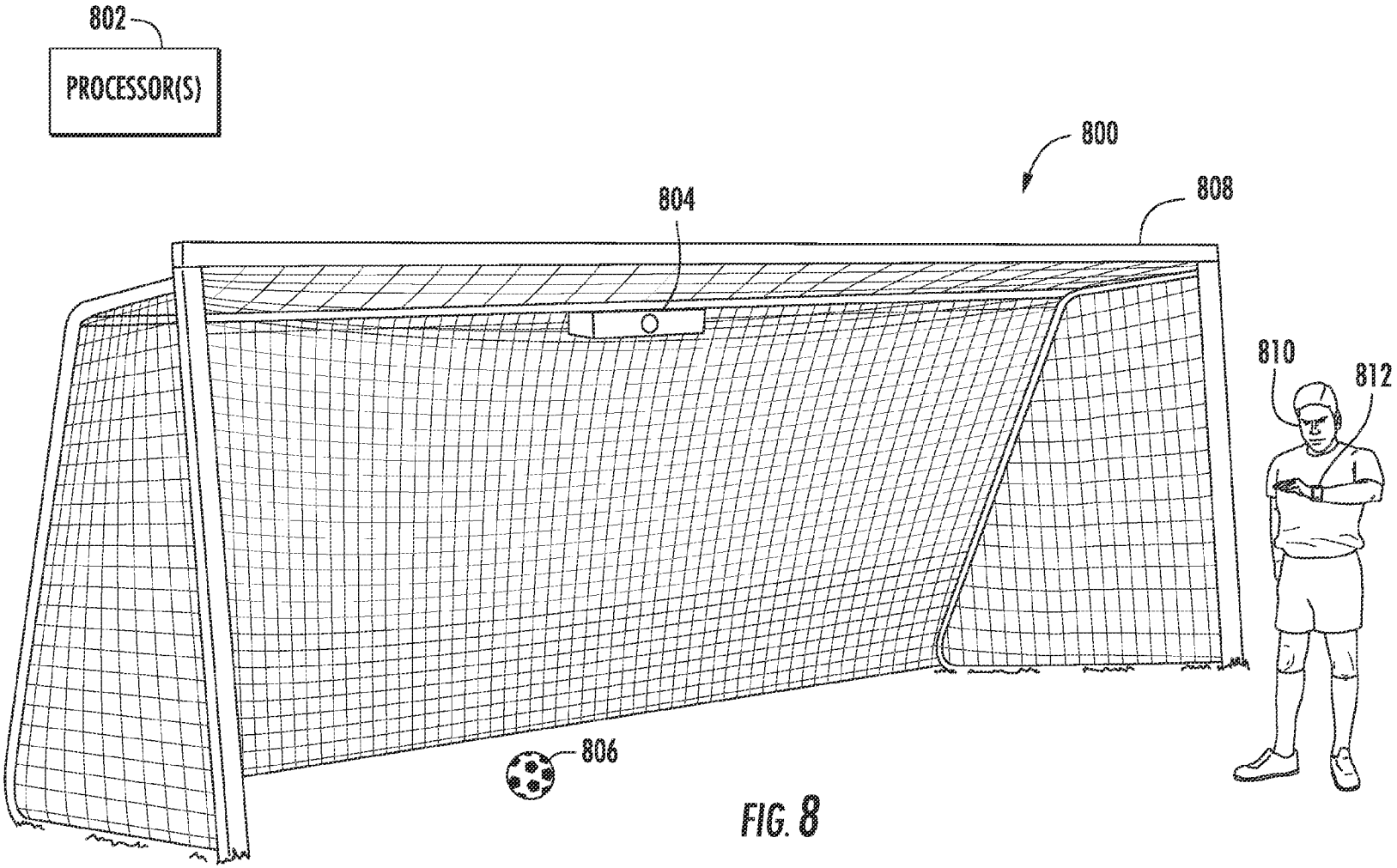
FIG. 8 shows a system in accordance with one embodiment.

Referring now to FIG. 8, an embodiment of a system 800 is shown, wherein system 800 comprises at least one processor 802, at least one 3D sensor 804, and computer executable instructions (not shown) readable by the at least one processor and operative to use at least one 3D sensor 804 to determine whether at least one ball 806 is within at least one goal 808, and notify at least one user 810 as to whether at least one ball 806 is within at least one goal 808.

In some embodiments, at least one processor 802 may be any type of processor, including, but not limited to, a single core processor, a multi core processor, a video processor, and the like. In one embodiment, at least one processor 802 may be electronically connected to at least one 3D sensor 804. The terms "electronically connected," "electronic connection," "connection" when used in the context of electronic devices, and the like, as used throughout the present disclosure, are intended to describe any type of electronic connection or electronic communication, such as, but not limited to, a physically connected or wired electronic connection and/or a wireless electronic connection, such as a direct connection, a connection through a network, or through wireless communications protocol such as Bluetooth® and Zigbee®. In yet another embodiment, at least one processor 802 may be positioned near, such as in the same location as, at least one 3D sensor 804. In yet another embodiment, at least one processor 802 may be integrated with at least one 3D sensor 804, such as by being positioned in the same housing as at least one 3D sensor 804. In yet another embodiment, at least one processor 802 may be positioned at a location remote from at least one 3D sensor 804, such as, but not limited to, by being located at a central station, such as a skybox, a sideline, a monitoring station, a television station or a server, such as a computer and/or network server.

The computer executable instructions may be loaded directly on at least one processor 802, or may be stored in a storage means, such as, but not limited to, computer readable media, such as, but not limited to, a hard drive, a solid state drive, a flash memory, random access memory, CD-ROM, CD-R, CD-RW, DVD-ROM, DVD-R, DVD-RW, and the like. The computer executable instructions may be any type of computer executable instructions, which may be in the form of a computer program, the program being composed in any suitable programming language or source code, such as C++, C, JAVA, JavaScript, HTML, XML, and other programming languages.

In some embodiments, at least one 3D sensor 804 may comprise a 3D camera. In another embodiment, at least one 3D sensor 804 may comprise any type of 3D sensor and/or 3D camera, such as, but not limited to those cameras and sensors developed and manufactured by PMDTechnologies, GmbH, Am Eichenhang 50, D-57076 Siegen, Germany; Canesta, Inc., 1156 Sonora Court, Sunnyvale, Calif., 94086, USA; and Optrima, NV, Witherenstraat 4, 1040 Brussels, Belgium; and the Bidirectional Screen developed by the Massachusetts Institute of Technology. At least one 3D sensor 804 may include a light source, such as an infrared light source, a laser, or a flash, which may be used to illuminate the objects in at least one sensor's 804 field of view. In preferred embodiments, at least one sensor 804 may include a field of view that includes goal 808. In a further embodiment, at least one 3D sensor 804 include a one hundred and eighty degree field of view, such as by including an ultra wide angle lens.

Accordingly, in one embodiment, the computer executable instructions may be operative to transmit or receive information to, from, or between at least one processor 802, at least one 3D sensor 804, and at least one notification apparatus 812. The information may be related to the presence of a ball in the goal, and may comprise additional information such as whether the ball is in the goal, at what time the ball was detected within the goal, how far within the goal the ball entered, and how long the ball has been or was in the goal for. The information may also comprise information captured by at least one 3D sensor 804, and the like.

In some embodiments, information relating to what is sensed by at least one 3D sensor 804 may be extracted and/or analyzed using object and/or image recognition software, 3D object and/or image recognition software, and/or gesture control software, such as those developed by Softkinetic S.A., 24 Avenue L. Mommaerts, Brussels, B-1140, Belgium, Microsoft Corp., and Omek Interactive, 2 Hahar Street, Industrial Zone Hare Tuv A, Ganir Center, Beith Shemesh 99067, Israel. In another embodiment, the information being analyzed by the object and/or image recognition software may comprise information or data captured by at least one 3D sensor 804.

In some embodiments, the information or the results of the analysis and/or extraction of the information captured by at least one 3D sensor 804 or related to the ball 806 or goal 808, may be transmitted to a notification apparatus 812, which may be used to notify at least one user 810. In some embodiments, the notification apparatus 812 may comprise an apparatus similar to apparatus 500, described above with reference to FIGS. 5A through 5C. In other embodiments, notification apparatus 812 may comprise an article of wear, such as a band, which may include a wristband, and armband, and like, with an alert means, wherein said alert means may comprise an audible alert means, such as an alarm, a tactile alert means, such as a vibrator, or a visual alert means such as a light or a display device. In a further embodiment, notification apparatus 812 may comprise a communications means, such as, but not limited to, a wireless communications means, which may include a Bluetooth® module, a Zigbee® module, a WiFi module, a GSM modem, and the like. Accordingly, in yet another embodiment, the computer executable instructions may be operative to use at least one notification apparatus 812 to notify at least one user 810 as to whether ball 806 is within goal 808.

According, in some embodiments, the computer executable instructions may be operative to use a communications means for transmitting or receiving information, wherein the communications means may comprise a wired communications means, such as a land line modem, cable modem, DSL modem, and the like, or a wireless communications means, such as a wireless modem, a GSM modem, a satellite modem, and Wi-Fi adapter, and the like. The communications means may be connected to or integrated with at least one of at least one processor 902, at least one sensor 904, and at least one notification apparatus 912.

In yet a further embodiment, at least one 3D sensor 804 may be positioned on or near at least one goal 808, such as, but not limited to, on top of or above at least one goal 808, in front of at least one goal 808, behind at least one goal 808, below at least one goal 808, to the side of at least one goal 808, inside at least one goal 808, outside at least one goal 808, or integrated with at least one goal 808, such as being built into or connected to at least one goal 808 (e.g. the structure of at least one goal 808, or the structure encompassing at least one goal 808).

In one embodiment, at least one goal 808 may be any kind of goal, such as, but not limited to, a soccer goal, a hockey goal, a field hockey goal, a water polo goal, and the like. At least one goal 808 may contain a net (not shown), and a structure, such as posts.

In another embodiment, at least one user 810 may be any kind of user, such as, but not limited to, a spectator, a player, a referee, a sideline referee or helper, a coach, and the like.

Figure 9:
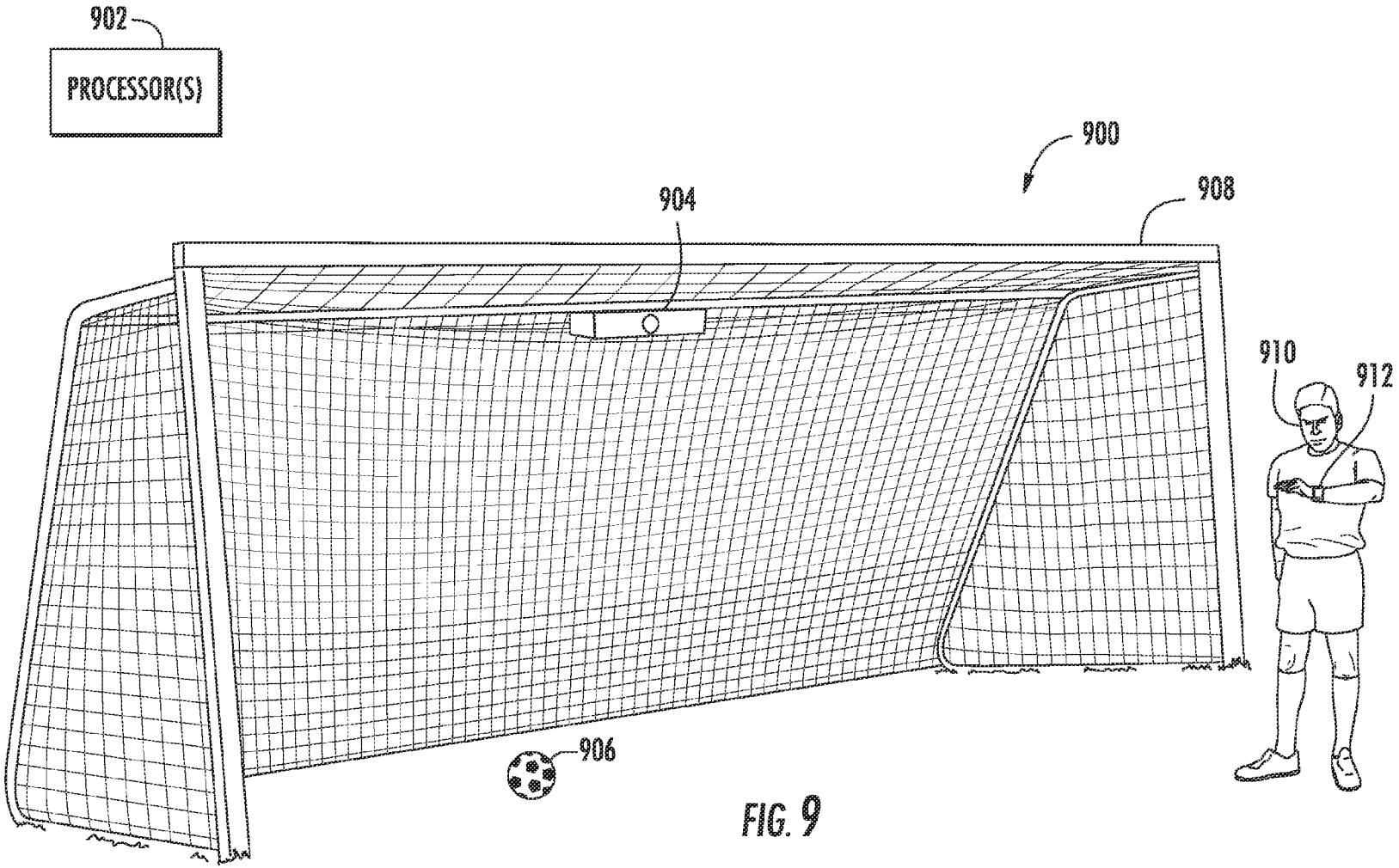
FIG. 9 shows a system in accordance with another embodiment.

Referring now to FIG. 9, an embodiment of system 900 is shown, wherein system 900 comprises at least one processor 902, at least one sensor 904, and computer executable instructions (not shown) readable by at least one processor 902 and operative to use at least one sensor 904 to determine whether at least one object 906 is within at least one boundary 908, and notify at least one user 910 as to whether at least one object 906 is within at least one boundary 908.

In some embodiments, at least one processor 902 may be any type of processor, including, but not limited to, a single core processor, a multi core processor, a video processor, and the like. In one embodiment, at least one processor 902 may be electronically connected to at least one sensor 904. In yet another embodiment, at least one processor 902 may be positioned near, such as in the same location as, at least one sensor 904. In yet another embodiment, at least one processor 902 may be integrated with at least one sensor 904, such as by being positioned in the same housing as at least one sensor 904. In yet another embodiment, at least one processor 902 may be positioned at a location remote from at least one sensor 904, such as, but not limited to, by being located at a central station, such as a skybox, a sideline, a monitoring station, a television station or a server, such as a computer and/or network server.

The computer executable instructions may be loaded directly on at least one processor 902, or may be stored in a storage means, such as, but not limited to, computer readable media, such as, but not limited to, a hard drive, a solid state drive, a flash memory, random access memory, CD-ROM, CD-R, CD-RW, DVD-ROM, DVD-R, DVD-RW, and the like. The computer executable instructions may be any type of computer executable instructions, which may be in the form of a computer program, the program being composed in any suitable programming language or source code, such as C++, C, JAVA, JavaScript, HTML, XML, and other programming languages.

In some embodiments, at least one sensor 904 may be any type of sensor, including, but not limited to, a camera, an infrared camera, a panoramic sensor, a stereo sensor, a three dimensional sensor and/or camera ("3D sensor"), a thermal imaging camera, a video sensor, a digital camera, and the like. At least one sensor 904 may include a light source, such as an infrared light source, a laser, or a flash, which may be used to illuminate the objects in the sensor's field of view. In preferred embodiments, at least one sensor 904 may include a field of view that encompasses the same field of view as, or larger than, at least one boundary 908. In a further embodiment, at least one sensor 904 may include a one hundred and eighty degree field of view, such as by including an ultra wide angle lens. In embodiments where at least one sensor 904 comprises a 3D sensor and/or camera, at least one sensor 904 may be any type of 3D sensor and/or camera, such as a those cameras developed and manufactured by PMDTechnologies, GmbH, Am Eichenhang 50, D-57076 Siegen, Germany; Canesta, Inc., 1156 Sonora Court, Sunnyvale, Calif., 94086, USA; and Optrima, NV, Witherenstraat 4, 1040 Brussels, Belgium; and the Bidirectional Screen developed by the Massachusetts Institute of Technology.

Accordingly, in one embodiment, the computer executable instructions may be operative to transmit or receive information to, from, or between at least one processor 902, at least one sensor 904, and at least one notification apparatus 912. The information may be related to the presence of at least one object 906 in boundary 908, and may comprise additional information such as whether the object 906 is in boundary 908, at what time object 906 was detected within boundary 908, how far within boundary 908 object 906 entered, and how long object 906 has been or was in boundary 908 for. The information may also comprise information captured by at least one sensor 904, and the like.

In some embodiments, information relating to what is sensed by at least one sensor 904 may be extracted and/or analyzed using object and/or image recognition software, 3D object and/or image recognition software, and/or gesture control software, such as those developed by Softkinetic S.A., 24 Avenue L. Mommaerts, Brussels, B-1140, Belgium, Microsoft Corp., and Omek Interactive, 2 Hahar Street, Industrial Zone Hare Tuv A, Ganir Center, Beith Shemesh 99067, Israel. In another embodiment, the information being analyzed by the object and/or image recognition software may comprise information or data captured by at least one sensor 904.

In some embodiments, the information or the results of the analysis and/or extraction of the information captured by at least one sensor 904 or related to object 906 or boundary 908, may be transmitted to notification apparatus 912, which may be used to notify at least one user 910. Accordingly, in some embodiments, at least one notification apparatus 912 may be operative to communicate with at least one processor 902. In some embodiments, the notification apparatus 912 may comprise an apparatus similar to apparatus 500, described above with reference to FIGS. 5A through 5C. In other embodiments, notification apparatus 912 may comprise an article of wear, such as a band, which may include a wristband, and armband, and like, with an alert means, wherein said alert means may comprise an audible alert means, such as an alarm or speaker, a tactile alert means, such as a vibrator, or a visual alert means such as a light or a display device. In a further embodiment, notification apparatus 912 may comprise a communications means, such as, but not limited to, a wireless communications means, which may include a Bluetooth® module, a Zigbee® module, a WiFi module, a GSM modem, and the like. Accordingly, in yet another embodiment, the computer executable instructions may be operative to use at least one notification apparatus 912 to notify at least one user 910 as to whether at least one object 906 is within at least one boundary 908.

According, in some embodiments, the computer executable instructions may be operative to use a communications means for transmitting or receiving information, wherein the communications means may comprise a wired communications means, such as a land line modem, cable modem, DSL modem, and the like, or a wireless communications means, such as a wireless modem, a GSM modem, a satellite modem, and Wi-Fi adapter, and the like. The communications means may be connected to or integrated with at least one of at least one processor 902, at least one sensor 904, and at least one notification apparatus 912.

In yet a further embodiment, at least one sensor 904 may be positioned on or near at least one boundary 908, such as, but not limited to, on top of or above at least one boundary 908, in front of at least one boundary 908, behind at least one boundary 908, below at least one boundary 908, to the side of at least one boundary 908, inside at least one boundary 908, outside at least one boundary 908, or integrated with at least one boundary 908, such as being built into or connected to at least one boundary 908 (e.g. the structure of at least one boundary 908 or the structure encompassing at least one boundary 908).

In one embodiment, at least one boundary 908 may be any kind of boundary, such as, but not limited to, a goal, a strike zone, an end zone, a portion of a playing field, an out of bounds area, a fairway, a green, a basketball hoop, and the like. In embodiments where at least one boundary 908 is a goal, at least one boundary 908 may be any kind of goal, such as, but not limited to, a soccer goal, a hockey goal, a field hockey goal, a water polo goal, a football goal and the like. At least one boundary 908 may contain a net (not shown), and a structure, such as posts.

In some embodiments, at least one object 906 may be any kind of object, such as a ball, which may include a soccer ball, a basketball, a football, and the like, a person, a stick, a club, a bat, a racquet, and the like.

In another embodiment, at least one user 910 may be any kind of user, such as, but not limited to, a spectator, a player, a coach, a referee, a sideline referee or helper, and the like.

Figure 10A:
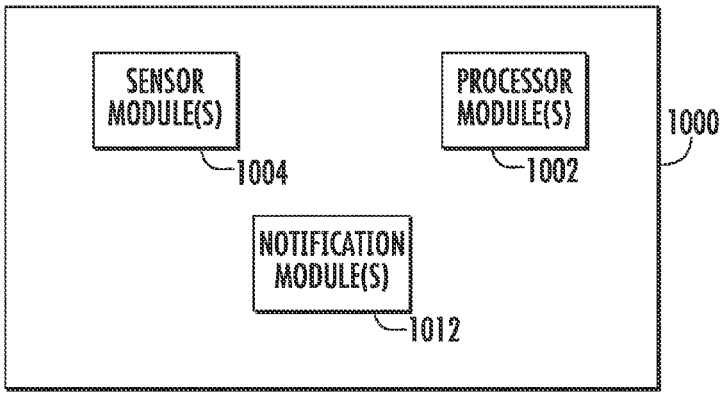
FIGS. 10A and 10B show a system in accordance with various other embodiments.
Figure 10B:
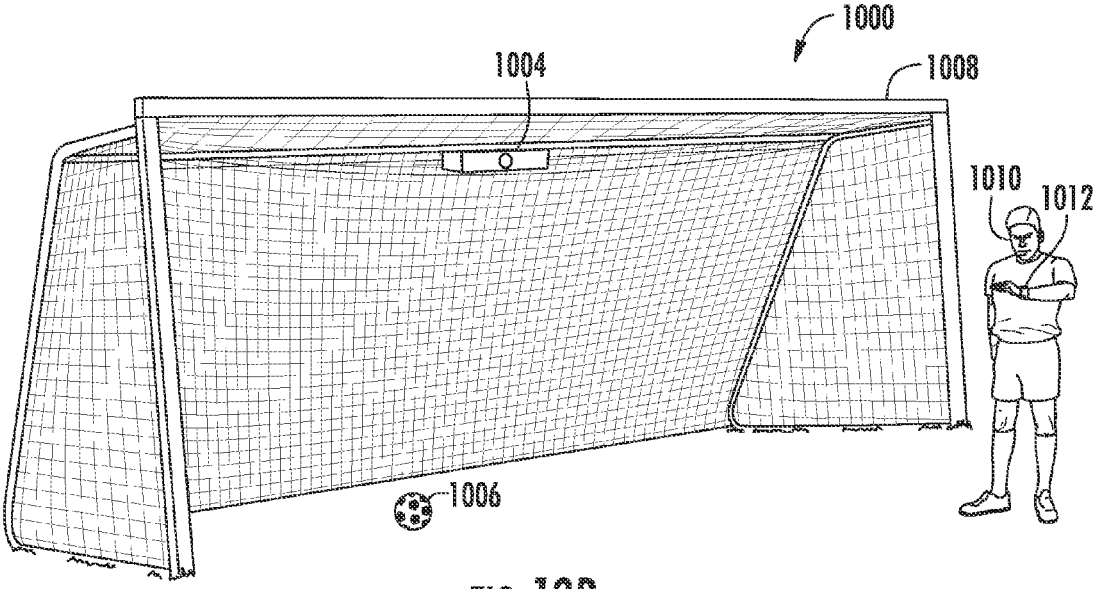

Referring now to FIGS. 10A and 10B, a system 1000 is shown, wherein system 1000 comprises at least one sensor module 1004 to sense the presence of at least one object 1006 within at least one boundary 1008, at least one processor module 1002 to determine whether at least one object 1006 is within at least one boundary 1008, and at least one notification module 1012 to notify at least one user 1010 as to whether at least one object 1006 is within at least one boundary 1008.

In one embodiment at least one processor module 1002 may comprise a software aspect, such as, but not limited to, processing software, such as processing computer program, an operating system, and the like. In another embodiment, at least one processor module 1002 may comprise a hardware aspect, such as a computer processor. In some embodiments, at least one processor module 1002 may be any type of processor, including, but not limited to, a single core processor, a multi core processor, a video processor, and the like. In yet another embodiment, at least one processor module 1002 may comprise both a software aspect and a hardware aspect.

In one embodiment, at least one processor module 1002 may be electronically connected to at least one sensor module 1004. In yet another embodiment, at least one processor module 1002 may be positioned near, such as in the same location as, at least one sensor module 1004. In yet another embodiment, at least one processor 1002 may be integrated with at least one sensor module 1004, such as by being positioned in the same housing as at least one sensor module 1004. In yet another embodiment, at least one processor module 1002 may be positioned at a location remote from at least one sensor module 1004, such as, but not limited to, by being located at a central station, such as a skybox, a sideline, a monitoring station, a television station or a server, such as a computer and/or network server.

In some embodiments, at least one sensor module 1004 may comprise a hardware aspect, such as, but not limited to, a sensor. In such embodiments, at least one sensor module 1004 may be any type of sensor module, including, but not limited to, a camera, an infrared camera, a panoramic sensor, a stereo sensor, a three dimensional sensor and/or camera ("3D sensor"), a thermal imaging camera, a video sensor, a digital camera, and the like. At least one sensor module 1004 may include a light source, such as an infrared light source, a laser, or a flash, which may be used to illuminate the objects in the sensor's field of view. In preferred embodiments, at least one sensor module 1004 may include a field of view that encompasses the same field of view as, or larger than, at least one boundary 1008. In a further embodiment, at least one sensor module 1004 may include a one hundred and eighty degree field of view, such as by including an ultra wide angle lens. In embodiments where at least one sensor module 1004 comprises a 3D sensor and/or camera, at least one sensor module 1004 may be any type of 3D sensor and/or camera, such as a those cameras developed and manufactured by PMDTechnologies, GmbH, Am Eichenhang 50, D-57076 Siegen, Germany; Canesta, Inc., 1156 Sonora Court, Sunnyvale, Calif., 94086, USA; and Optrima, NV, Witherenstraat 4, 1040 Brussels, Belgium; and the Bidirectional Screen developed by the Massachusetts Institute of Technology.

In yet another embodiment, at least one sensor module 1004 may comprise a software aspect, such as a computer program. In such an embodiment, at least one sensor module 1004 may comprise sensor and/or camera firmware, or object or image recognition software, and/or gesture control software, such as those developed by Softkinetic S.A., 24 Avenue L. Mommaerts, Brussels, B-1140, Belgium, Microsoft Corp., and Omek Interactive, 2 Hahar Street, Industrial Zone Hare Tuv A, Ganir Center, Beith Shemesh 99067, Israel. In some embodiments, information relating to what is sensed by at least one sensor module 1004 may be extracted and/or analyzed using object and/or image recognition software, 3D object and/or image recognition software, and/or gesture control software. In another embodiment, the information being analyzed by the object and/or image recognition software may comprise information or data captured by at least one sensor module 1004. In yet another embodiment, at least one sensor module 504 may comprise both a software aspect and a hardware aspect. In one embodiment, at least one processor module 502 may be electronically connected, electronic communication, or in software communication with at least one sensor module 504.

In some embodiments, the information or the results of the analysis and/or extraction of the information captured by at least one sensor module 1004 or related to object 1006 or boundary 1008, may be transmitted to notification module 1012, which may be used to notify at least one user 1010. Accordingly, in some embodiments, at least one notification module 1012 may be operative to communicate with at least one processor module 1002.

In some embodiments, at least one notification module 1012 may comprise a hardware aspect, such as an apparatus similar to apparatus 500, described above with reference to FIGS. 5A through 5C. In other embodiments, notification module 1012 may comprise an article of wear, such as a band, which may include a wristband, and armband, and like, with an alert means, wherein said alert means may comprise an audible alert means, such as an alarm and speaker, a tactile alert means, such as a vibrator, or a visual alert means such as a light or a display device. In a further embodiment, notification module 1012 may comprise a communications means, such as, but not limited to, a wireless communications means, which may include a Bluetooth® module, a Zigbee® module, a WiFi module, a GSM modem, and the like. In yet another embodiment, at least one notification module 1012 may comprise a software aspect, such as communications software to communicate notification information, display software to display a notification, such as that produced by a light or display device, audio software to product a notification sound, and/or mechanical device controller software to produce a tactile notification, such as that produced by a vibrator.

In yet another embodiment, system 1000 may comprise at least one communications module to transmit or receive information. The information may comprise any type of information, such as, but not limited to, information related to or captured by at least one sensor module 1004, or notification information. In one embodiment, the at least one communications module may comprise a hardware aspect, such as but not limited to, wireless communications hardware, such as, but not limited to, a wireless modem, a GSM modem, a Wi-Fi modem, an antenna, a satellite modem, a Bluetooth modem, and the like, or wired hardware, such as a DSL modem, a cable modem, a network card, a telephone modem, and the like. In yet another embodiment, the at least one communications module may comprise a software aspect, such as, but not limited to, a computer program or software, such as, but not limited to, a communications program, communications protocol, and the like. In yet another embodiment, the at least one communications module may comprise both a hardware aspect and a software aspect. In further embodiments, the communications module may be connected to or integrated with at least one of at least one processor module 1002, at least one sensor module 1004, and at least one notification module 1012.

Figure 13A:
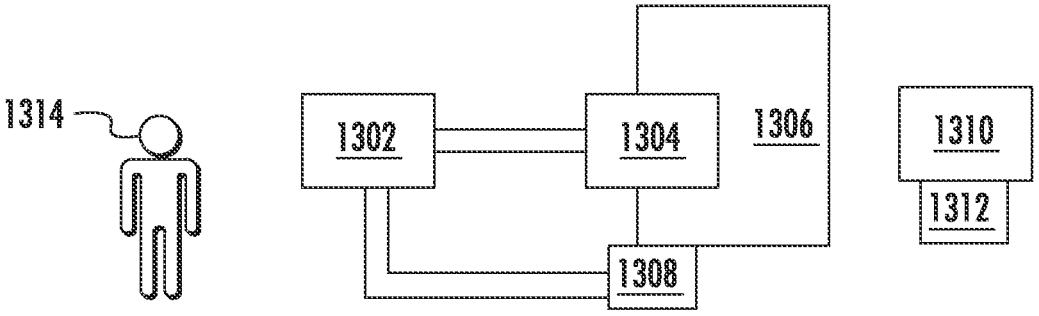
FIGS. 13A and 13B show a system in accordance with one embodiment.
Figure 13B:
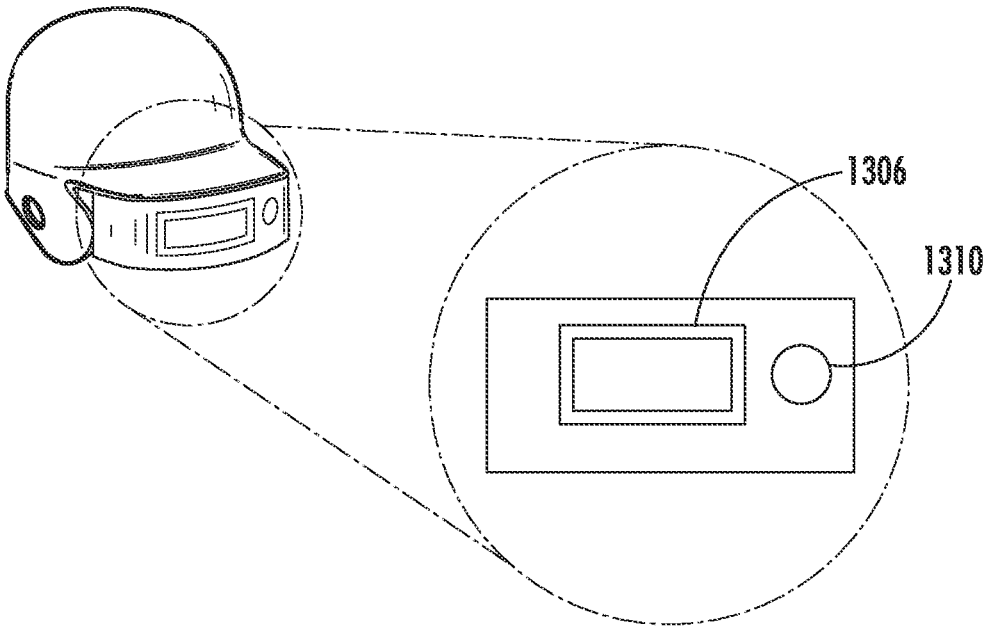

Referring now to FIGS. 13A and 13B, a system 1300 is shown in accordance with one embodiment, wherein system 1300 comprises at least one processor 1302, at least one 3D camera 1304 connected to at least one processor 1302 and positioned on or near at least one boundary 1306, at least one radio frequency identification ("RFID") tag reader 1308 positioned on or near at least one boundary 1306, at least one object 1310 having at least one RFID tag connected thereto, and computer executable instructions readable by at least one processor 1302, and operative to use 3D camera 1304 to determine whether object 1310 is within or encroaching boundary 1306, use the RFID tag reader 1308 to determine whether object 1310 or RFID tag 1312 is within, near, or encroaching boundary 1306, and notify at least one user 1314 when object 1310 encroaches, is within, or is near boundary 1306.

In some embodiments, system 1300 further comprises at least one headwear display device wearable by at least one user 1314, wherein the computer executable instructions are operative to use the headwear display device to display a visual representation of the at least one boundary 1306 and/or object 1310, object 1310's position relative to boundary 1306, and change a color of the visual representation of boundary 1306 and/or object 1310 when object 1310 is within, near, or encroaches upon boundary 1306. In a further embodiment, the color may change or vary based on how close object 1310 gets to or is to boundary 1306. For example, the color of the visual representation may change from green to red if the object encroaches the boundary. In another embodiment, if the object gets near, the color may change to yellow. The change may be a sudden change, or a gradual change, such as a fade. In some embodiments, if the system is unable to tell whether object 1310 has encroached upon boundary 1306, then the computer executable instructions may be operative to use the display device to alert user 1314 of this fact, such as by displaying a message, a symbol, or changing the color of the visual representation of the boundary and/or object.

The headwear display device may comprise a hat, a helmet, a headband, and a display device connected thereto, such as an LCD screen positioned in front of at least one of user 1314's eyes, or a heads up display that is operative to project an image on a visor connected to the headwear or other display surface.

The visual representation of the boundary 1306 and/or object 1310 may be based on a 3D image of the boundary 1306 and/or object 1310 captured by 3D camera 1304. For example, the computer executable instructions may be operative to create the visual representation based on the 3D information captured by the 3D camera 1304. In another embodiment, the visual representation may be based on information collected by RFID tag reader 1308, such as the distance a plurality of RFID tags positioned on or near boundary 1306 and/or object 1310 are from RFID tag reader 1308.

Boundary 1306 may be any type of boundary, such as a sports boundary, which may include, but is not limited to, a soccer goal, a baseball strike zone, a football-end zone, and off sides area, a basketball hoop, and the like. User 1314 may be any type of user, such as a spectator, a referee, or a player.

Overview of Method Embodiments

Figure 11:
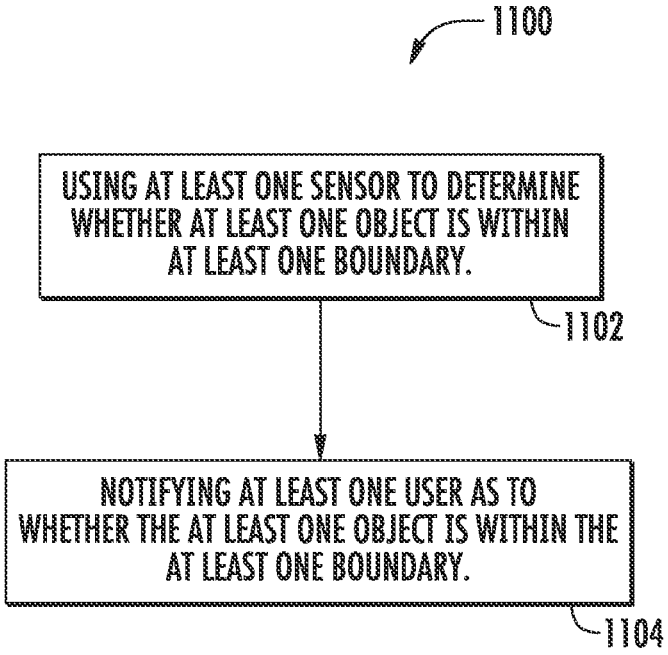
FIG. 11 is a block diagram depicting a method in accordance with one embodiment.

Referring now to FIG. 11, an embodiment of a method 1100 is shown, wherein method 1100 comprises using at least one processor to perform any or all of the following: using at least one sensor to determine whether at least one object is within at least one boundary (block 1102), and notifying at least one user as to whether the at least one object is within the at least one boundary.

In one embodiment, notifying at least one user as to whether the at least one object is within the at least one boundary comprises using at least one communications means and/or notification means to notify at least one user as to whether the at least one object is within the at least one boundary. Said communications means may be similar to any of the various embodiments of communications means (including hardware and software) described herein with reference to FIGS. 1A through 13. Said notification means may be similar to any of the various notifications means, modules, and apparatuses described herein with reference to FIGS. 1A through 13.

In some embodiments, the at least one processor may be any kind of processor, such as those various embodiments of processors described herein with reference to FIGS. 1A through 13.

In another embodiment, the at least one sensor may be any kind of sensor, such as those various embodiments of sensors described herein with reference to FIGS. 1A through 13.

In yet another embodiment, the at least one object may be any of those objects, including the various sports articles, such as balls, described herein with reference to FIGS. 1A through 13.

In another embodiment, the at least one boundary may be any of those boundaries, including the various sports related boundaries, such as goals and strike zones, described herein with reference to FIGS. 1A through 13.

In yet another embodiment, the at least one user may be any kind of user, including the various sports related users, such as referees, players, and coaches, described herein with reference to FIGS. 1A through 13.

In yet another embodiment, method 1100 may comprise using at least one object and/or image tracking or recognition software to determine whether at least one object is within at least one boundary. The object and/or image recognition software may be any kind of object or image recognition software, and/or gesture control software, such as those developed by Softkinetic S.A., 24 Avenue L. Mommaerts, Brussels, B-1140, Belgium, Microsoft Corp., and Omek Interactive, 2 Hahar Street, Industrial Zone Hare Tuv A, Ganir Center, Beith Shemesh 99067, Israel.

Overview of Computer Readable Medium Embodiments

In another embodiment, a computer readable medium may have computer executable instructions operative to determine whether at least one ball is within a goal, and notify at least one user as to whether at least one ball is within the goal.

In some embodiments, the computer executable instructions may be operative to use at least one sensor, such as a 3D sensor, or any other the various other embodiments of sensors described throughout the present disclosure, to determine whether at least one ball is within a goal.

The computer executable instructions may be further operative to perform any or all of the other functions related to notifying a user as to the presence of an object within a boundary, as described throughout the present disclosure, and use any or all of the various apparatuses, systems, methods, modules, means, and the like, including, but not limited to, processors, sensors, and the like, as described throughout the present disclosure.

The computer readable medium may be any kind of computer readable medium, such as those various embodiments described herein with reference to FIGS. 1A through 12, which may include, but is not limited to, CD-ROMs, DVDs, flash memory, RAM, hard drives, and the like.

Hardware and Operating Environment

This section provides an overview of an example hardware and the operating environments in conjunction with which embodiments of the inventive subject matter can be implemented.

A software program may be launched from a computer readable medium in a computer-based system to execute function defined in the software program. Various programming languages may be employed to create software programs designed to implement and perform the methods disclosed herein. The programs may be structured in an object-orientated format using an object-oriented language such as Java or C++. Alternatively the programs may be structured in a procedure-oriented format using a procedural language, such as assembly or C. The software components may communicate using a number of mechanisms, such as application program interfaces, or inter-process communication techniques, including remote procedure calls. The teachings of various embodiments are not limited to any particular programming language or environment. Thus, other embodiments may be realized, as discussed regarding FIG. 12 below.

Figure 12:
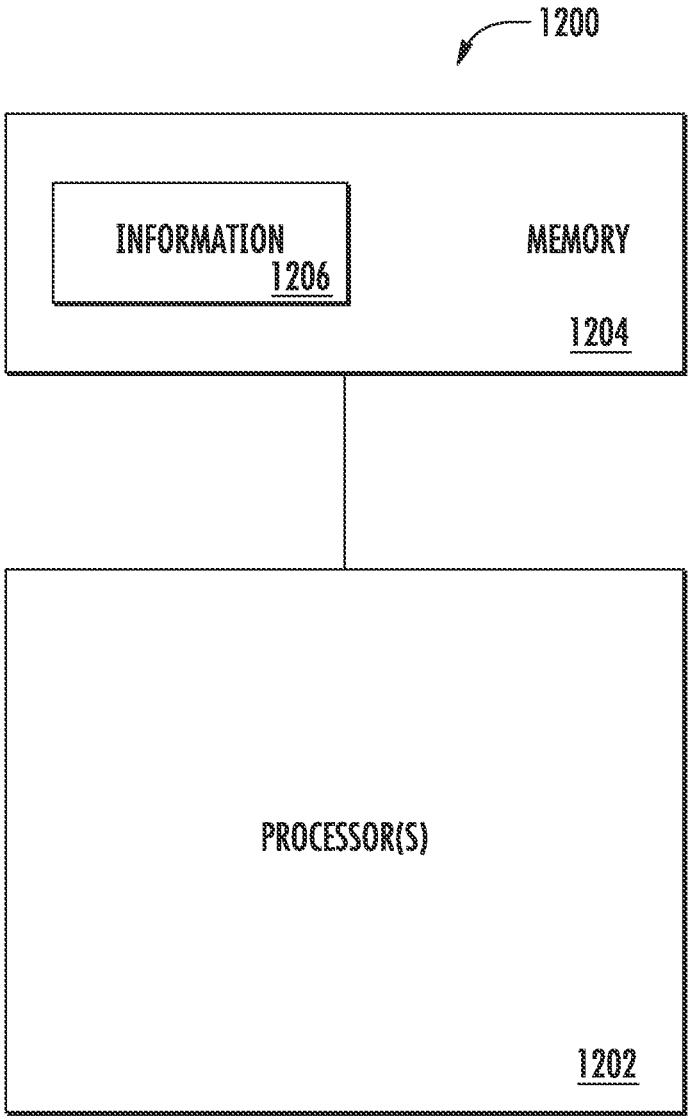
FIG. 12 is a block diagram representing an article according to various embodiments.

FIG. 12 is a block diagram representing an article according to various embodiments. Such embodiments may comprise a computer, a memory system, a magnetic or optical disk, some other storage device, or any type of electronic device or system. The article 1200 may include one or more processor(s) 1202 couple to a machine-accessible medium such as a memory 1204 (e.g., a memory including electrical, optical, or electromagnetic elements). The medium may contain associated information 1206 (e.g., computer program instructions, data, or both) which, when accessed, results in a machine (e.g., the processor(s) 1202) performing the activities previously described herein.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A system comprising:

at least one processor;

at least one 3D camera connected to the at least one processor and positioned on or near at least one boundary;

at least one radio frequency identification tag reader connected to the at least one processor and positioned on or near the at least one boundary;

at least one object having at least one radio frequency identification tag connected thereto; and computer executable instructions readable by the at least one processor and operative to:

use the at least one 3D camera to determine whether the at least one object is within at least one boundary;

use the at least one radio frequency identification tag reader to determine whether the at least one radio frequency identification tag is within, near, or encroaching the at least one boundary; and notify at least one user when the at least one object is within, near, encroaching the at least one boundary by projecting a visual representation of the boundary and/or object.

2. The system of claim 1, further comprising at least one headwear display device wearable by the at least one user, wherein the computer executable instructions are operative to use the headwear display device to display a visual representation of the at least one boundary.

3. The system of claim 1, further comprising at least one headwear display device wearable by the at least one user, wherein the computer executable instructions are operative to use the headwear display device to show a visual representation of the at least one object.

4. The system of claim 1, further comprising at least one headwear display device wearable by the at least one user, wherein the computer executable instructions are operative to use the headwear display device to show a visual representation of the at least one object and the at least one boundary, and the at least one object's position relative to the at least one boundary.

5. The system of claim 1, further comprising at least one headwear display device wearable by the at least one user, wherein the computer executable instructions are operative to use the headwear display device to show a visual representation of the at least one object and the at least one boundary, and the at least one object's position relative to the at least one boundary and change a color of the visual representation of the at least one boundary or the visual representation of the at least one object, when the at least one object is within, near, or encroaching upon the at least one boundary.

6. The system of claim 5, wherein the color of the visual representation of the at least one object or the at least one boundary changes or varies based on how close the at least one object gets to the at least one boundary.

7. The system of claim 1, wherein the at least one boundary is a soccer goal, a baseball strike zone, or a football end-zone.

8. The system of claim 1, wherein the at least one user is a type of user selected from the group consisting essentially of: a spectator, a referee, and a player.

9. A system comprising:

at least one processor;

at least one sensor connected to the at least one processor and positioned on or near at least one boundary;

at least one headwear display device wearable by at least one user; and computer executable instructions readable by the at least one processor and operative to:

use the at least one sensor to determine whether at least one object is within, near, or has encroached upon the at least one boundary;

use the headwear display device to display a visual representation of the at least one boundary or the at least one object; and notify at least one user as to whether the at least one object is within, near, or has encroached upon the at least one boundary by projecting a visual representation of the boundary and/or object.

10. The system of claim 9, wherein the at least one sensor comprises at least one 3D camera.

11. The system of claim 9, wherein notifying the at least one user as to whether the at least one object is within, near or has encroached upon the at least one boundary comprises changing a color of the visual representation of the at least one boundary or the visual representation of the at least one object, when the at least one object is within, near, or encroaches upon the at least one boundary.

12. The system of claim 11, wherein the color of the visual representation of the at least one object or the at least one boundary changes or varies based on how close the at least one object gets to the at least one boundary.

13. The system of claim 9, wherein the headwear display device comprises at least one helmet and at least one heads up display device connected to the at least one helmet.

14. The system of claim 9, wherein the computer executable instructions are operative to alert the at least one user if the computer executable instructions are unable to determine whether or not the at least one object has encroached upon the boundary.

15. The system of claim 9, wherein the at least one object is a type of object selected from the group consisting essentially of: a ball, a puck, a club, a bat, a stick, and a person.

16. The system of claim 9, wherein the at least one user is a type of user selected from the group consisting essentially of: a referee, a player, a coach, and a spectator.

17. The system of claim 9, wherein the at least one boundary is a type of boundary selected from the group consisting essentially of a soccer goal, a baseball strike zone, a hockey goal, a football end zone, a football goal, and a basketball hoop.

18. A system comprising:

at least one processor;

at least one sensor connected to the at least one processor;

at least one headwear display device; and computer executable instructions readable by the at least one processor and operative to:

use the at least one sensor to sense at least one boundary and at least one object;

use the at least one sensor to determine if the at least one object has encroached on the at least one boundary;

use the headwear display device to display a visual representation of the at least one boundary and/or the at least one object; and change a color of the visual representation of the at least one boundary or the visual representation of the at least one object, when the at least one object is within, near, or encroaching upon the at least one boundary.

19. The system of claim 18, wherein using the at least one sensor to sense at least one boundary and at least one object comprises using at least one 3D camera to capture at least one 3D image of the at least one boundary and at least one object.

20. The system of claim 19, wherein the visual representation is based on the 3D image of the at least one boundary.

* * * * *